US005081931A

United States Patent [19]

Frye et al.

[11] Patent Number: 5,081,931

[45] Date of Patent: Jan. 21, 1992

[54] SPIN STABILIZED CARRIER PROJECTILE PROVIDED WITH A METAL DRIVING BAND

[75] Inventors: Günter Frye, Erkrath; Klaus-Dietmar Karius, Jüchen; Heinz-Josef Kruse; Achim Sippel, both of Ratingen; Jürgen Meyer, Cologne; Michael Primus, Ratingen, all of Fed. Rep. of Germany

[73] Assignee: Rheinmetall GmbH, Düsseldorf, Fed. Rep. of Germany

[21] Appl. No.: 635,826

[22] Filed: Jan. 3, 1991

[30] Foreign Application Priority Data

Jan. 5, 1990 [DE] Fed. Rep. of Germany ..... 4000167

[51] Int. Cl.[5] ..... F42B 12/62; F42B 14/02

[52] U.S. Cl. ..... 102/489; 102/473; 102/517; 102/524; 102/527

[58] Field of Search ..... 102/473, 489, 340, 342, 102/351, 357, 517, 520, 524–527

[56] References Cited

U.S. PATENT DOCUMENTS

| | | | |
|---|---|---|---|
| 3,786,760 | 1/1974 | Feldmann . | |
| 4,771,696 | 9/1988 | Smalnik | 102/489 |
| 4,793,260 | 12/1988 | Kruse et al. | 102/489 |
| 4,803,929 | 2/1989 | Kruse et al. . | |
| 4,884,508 | 12/1989 | Kruse et al. . | |
| 5,033,388 | 7/1991 | Sippel | 102/489 |

*Primary Examiner*—Harold J. Tudor
*Attorney, Agent, or Firm*—Spencer & Frank

[57] ABSTRACT

To provide a complete seal in the region of the rifling, particularly in worn-out gun barrels firing spin stabilized carrier projectiles provided with a metal guide or driving band and a thin-walled projectile connected to a projectile base and having a wall thickness less than or equal to 0.05 times the caliber of the gun barrel and to reduce the ramming deceleration and the radial pressure stresses on the projectile shell during passage through the gun barrel, a plastic ram ring is disposed on the outer surface of the projectile shell in front of the metal guide band and in a region of the shell that is not supported radially by the projectile base.

11 Claims, 1 Drawing Sheet

SPIN STABILIZED CARRIER PROJECTILE PROVIDED WITH A METAL DRIVING BAND

BACKGROUND OF THE INVENTION

The present invention relates to a spin stabilized carrier projectile provided with a metal driving band and a thin-walled shell which is connected to the projectile base and which has a wall thickness less than or equal to 0.05 times the caliber of the gun barrel from which the projectile is to be fired.

Federal Republic of Germany DE 3,734,033.A1, corresponding to U.S. Pat. No. 4,884,508, discloses that, in order to transfer spin in artillery carrier projectiles, it is necessary to use higher strength driving bands, for example, metal driving bands made of copper and soft iron. In order to absorb the radial pressure generated at the moment of introduction of the carrier projectile into the calibrated portion of the gun barrel, the driving bands are arranged on a region of the thin-walled projectile shell which is radially supported by the projectile base. Such an arrangement is necessary because the radial pressure generated by the metal driving band and acting on a thin-walled projectile shell not supported by the projectile base would become too great, and sufficient radial support of the thin-walled projectile shell relative to the submunition units which are disposed in the carrier projectile, and which are sensitive to radial pressure, would no longer be ensured.

During the process of ramming such a carrier projectile, particularly in an automatic ramming process (flick ramming), the metal driving band also produces considerable axial braking. The deceleration this involves may lie in an order of magnitude of 1,000 G, thus possibly making the ramming process hard and sudden which may cause malfunctions, particularly in connection with electronic components or fuzes disposed in the submunition of the carrier projectile.

Another drawback is the problem that occurs when the carrier projectile is rammed into a worn-out gun barrel in that no complete seal is obtained in the region of the rifling. Such a seal is ensured only at the moment when an obturator disposed on the projectile base at the tail behind the driving band is introduced into the calibrated portion of the gun barrel.

SUMMARY OF THE INVENTION

It is therefore an object of the present invention to improve a spin stabilized carrier projectile of the type discussed above and including a metal driving band and a thin walled shell connected to a projectile base in such a manner that a complete seal is realized, already during ramming, even in the region of the rifling of the gun barrel, and the ramming deceleration as well as the radial pressure created thereby does not produce any malfunctions in the submunition.

The above object is generally accomplished according to the present invention in that in a carrier projectile of the type mentioned above, a plastic ram ring is disposed in front of the metal driving band and on a region of the projectile shell which is not supported by the projectile base.

Due to the invention, during ramming of the carrier projectile, the projectile is now advantageously braked softly because the ram ring, whose elasticity is much greater compared to copper and iron, digs itself into the rifling and lands of the gun barrel over an enlarged deceleration path. This reduces the axial deceleration of the carrier projectile to such a value that the electronic components or fuzes disposed in the submunition are protected.

The ram ring advantageously performs a further function, namely to ensure complete gas tightness in the region of the rifling already during ramming of the carrier projectile, even in worn-out gun barrels.

Moreover, the ram ring reduces the volume of the gun barrel chamber, with the length of the ram ring and/or its distance from the driving band being variable so that it is possible to subsequently adapt the inner ballistic characteristics to possibly given reference projectiles.

The radial pressure on the projectile shell at the moment of introduction into the calibrated portion of the gun barrel is as great as the dynamic strength of the material of the driving band. Since the strength of plastic is only about half that of copper and only about one third that of soft iron, the radial pressure on the thin-walled projectile shell is reduced correspondingly in the region of the ram ring. Even at the moment of maximum acceleration during passage through the gun barrel, during which the projectile shell is subjected to maximum stress in the region of the driving band, the plastic ram ring, compared to a corresponding metal ring, produces a reduced radial pressure stress, thus permitting further reduction of the wall thickness of the projectile shell. Therefore, the ram ring can advantageously also be applied to a region of the projectile shell in which radial support of the projectile shell from the interior can no longer be ensured because this is where, for example, submunition units are disposed which are sensitive to radial pressure.

The present invention will now be described below in greater detail with reference to embodiments thereof that are illustrated in the drawing figures.

DETAILED DESCRIPTION OF THE PREFERRED EMBODIMENTS

Figure 1:
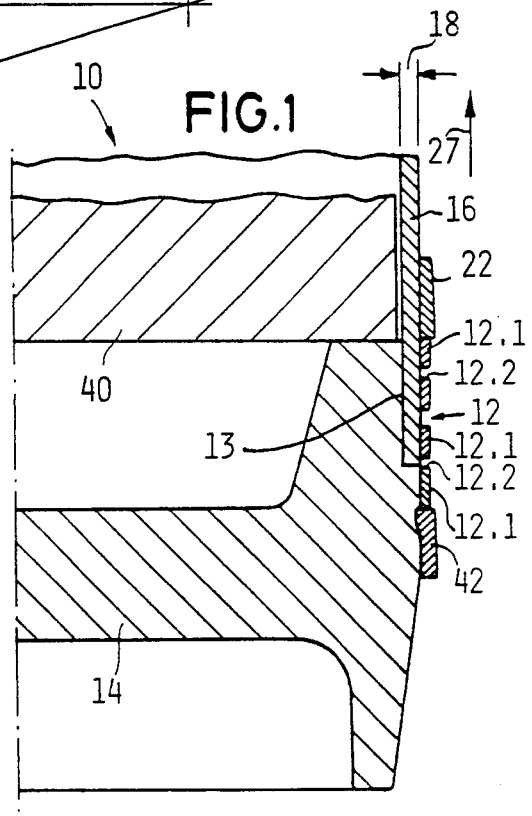
FIG. 1 is a partial sectional view of a carrier projectile including a projectile base with a projectile shell connected to it, as well as a driving band, a ram ring and an obturator or sealing ring.

FIG. 1 shows the tail end of a spin stabilized artillery carrier projectile 10 which, in a conventional manner, receives, on a projectile base 14 and within a thin-walled projectile shell 16, a plurality of submunition pieces 40, only one of which is partly schematically shown. The thin-walled projectile shell 16 has a wall thickness 18 which is equal to or less than 0.05 times the caliber 20 of the gun barrel (FIG. 4) from which the projectile is to be fired and which overlaps, and is fastened to, the exterior of the projectile base 14 over a partial region 13.

A metal driving or guide band 12 is disposed on the exterior of the projectile base 14 and the projectile shell 16 in a region preferably supported by projectile base 14, i.e., the overlapped region 13. In a known manner, this driving band 12 may be composed of copper or soft iron and includes a plurality of webs 12.1 and grooves 12.2, with only the webs 12.1 being active in the transfer of spin. Grooves 12.2 here preferably serve to receive the material of the driving band which is sheared off during introduction of the projectile into the calibrated portion of gun barrel 36 (FIG. 4) and to reduce the radial pressure directed onto the projectile base 14. A known plastic sealing ring 42, also called an obturator, as it has been customarily employed to provide a complete seal in artillery projectiles, particularly for worn-out gun barrels, is disposed on the outer surface of the base 14 behind the driving band 12.

In front of metal driving band 12, when seen in the direction of firing, in a region of the projectile shell 16 which is not supported radially by the projectile base 14, i.e., in a region in front of the overlapped region 13, a plastic ram ring 22 is provided on the circumferential surface of the shell 16. Suitable materials for ram ring 22 are, for example, hard PVC or polyamide 6.

Figure 4:
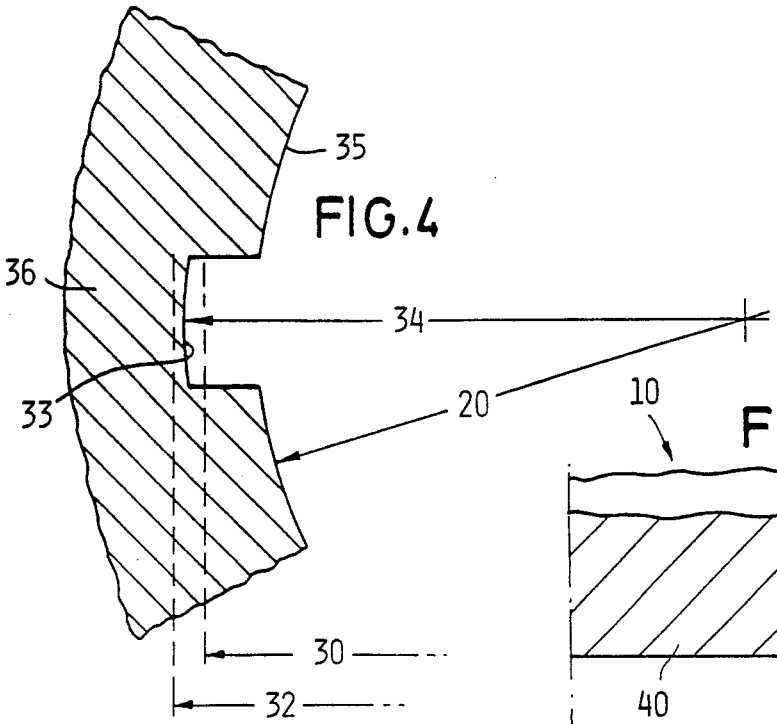
FIG. 4 is a partial cross-sectional view of a gun barrel including rifling and lands for explaining the present invention.
Figure 3:
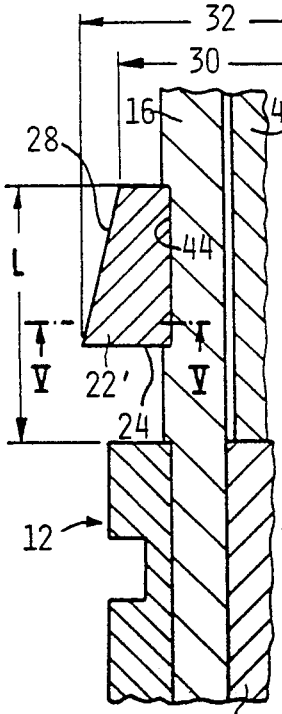
FIG. 3 is an enlarged sectional view of another embodiment of a ram ring according to the invention arranged in front of and at a distance from the driving band.
Figure 2:
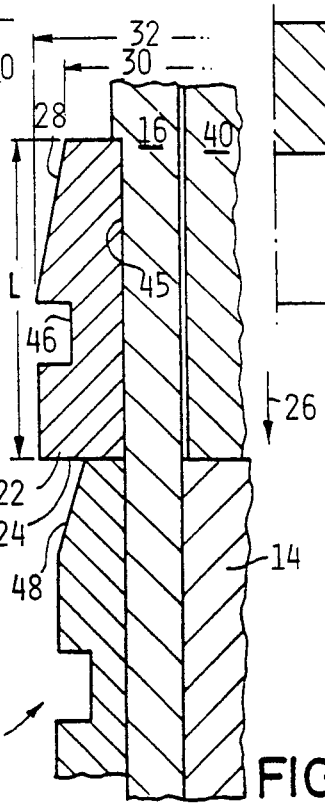
FIG. 2 is an enlarged sectional view showing one embodiment of the ram ring according to the invention lying directly in front of the driving band.

As shown in FIGS. 2 and 3, the outer circumferential surface 28 of ram ring 22, 22', extending from the forward end surface, may be partially or entirely conically forwardly tapered, with the forward cone diameter 30 possibly being smaller and the rearward cone diameter 32 being larger than the rifling diameter 34 of gun barrel 36 shown in FIG. 4. Depending on the configuration of the transition region from the chamber to the rifling region in the gun barrel 36, it may be necessary, in order to provide for better ramming of carrier projectile 10, to reduce the forward cone diameter 30 of ram ring 22 or 22' down to the caliber dimension 20. Due to the compressibility of plastic ram ring 22, 22', a complete seal of the chamber is realized even in a gun barrel 36 which is worn-out.

Ram ring 22 (FIG. 2) includes a rear end supporting surface 24 which, in the axially rearwardly oriented direction 26, lies against a parallel forward end surface of driving band 12. However as shown in FIG. 3, the rear end surface 24 of ram ring 22' may be longitudinally spaced from the forward end surface of the driving band 12.

After ramming, the tail of carrier projectile 10, beginning approximately at the front edge of ram ring 22, 22', projects into the chamber (not shown) of gun barrel 36. Compared to a carrier projectile without a ram ring (not shown), the effective volume of the barrel chamber is reduced by the partial volume $\Delta_v = \pi/4 \cdot d_{20}^2 \cdot L$, where L is the length of ram ring 22 (FIG. 2) or a distance measure between the front end of ram ring 22' and the front end of driving band 12 (FIG. 3), and $d_{20}$ is the caliber 20 of the gun barrel. Thus, for example, in a 155-mm artillery projectile, each millimeter of length L for ram ring 22 or 22' results in a reduction of the chamber by 19 $cm^3$. In this way it becomes advantageously possible to vary the effective chamber volume and the gas pressure. With every reduction of the chamber realized by ram ring 22 or 22', the gas pressure increases and thus the range of the carrier projectile is lengthened due to its greater initial velocity $v_0$. As a result, ram ring 22, 22' permits internal and external ballistic adaptation of the thin-walled carrier projectile 10 to comparison projectiles (not shown) and to existing firing tables, respectively.

Figure 5:
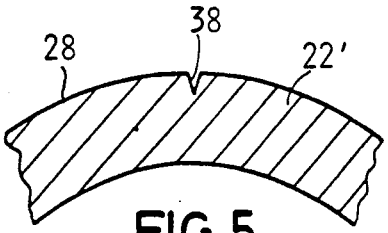
FIG. 5 is a sectional view of a ram ring along the line marked V—V in FIG. 3.

Ram ring 22 or 22' is not provided to transfer spin to carrier projectile 10. Therefore the ram ring need not be connected with projectile shell 16 in a force or form locking manner. Assembly may be such that ram ring 22 or 22', in a slightly heated state, is pushed from the tip of the projectile over the projectile shell 16 and is seated, for example, in a respective circumferential recess 44 or 45 in projectile shell 16. It is also possible to manufacture ram ring 22 or 22' of two or more parts and to glue it onto projectile shell 16. In any case, centrifugal force separates ram ring 22 or 22' from projectile shell 16 after it leaves gun barrel 36, and thus the ram ring does not constitute an adverse influence on the external ballistic characteristics of the carrier projectile 10. The separation of ram ring 22 or 22' may be initiated immediately upon leaving gun barrel 36 by at least one longitudinal slot 38 disposed in the external circumferential surface 28 of ram ring 22' as shown in FIG. 5.

If ram ring 22 or 22' has a greater length, its circumferential surface (as well as that of driving band 12) may be provided with one or a plurality of circumferential grooves 46 to accommodate the material sheared off in the region of the lands. When the end surface 24 of ram ring 22 lies against the driving band 12, the circumferential surface of driving band 12 adjacent its forward end surface may be provided with a forwardly sloped or conically tapered area 48 as shown in FIG. 2 in order to accommodate sheared-off material.

The invention now being fully described, it will be apparent to one of ordinary skill in the art that any changes and modifications can be made thereto without departing from the spirit or scope of the invention as set forth herein.

What is claimed is:

1. A spin stabilized carrier projectile to be fired from a rifled gun barrel of a given caliber, said projectile comprising: a thin-walled shell having a wall thickness equal to or less than 0.05 times the caliber of the gun barrel; a projectile base connected to a rear end of said shell and partially overlapped by said rear end of said shell so that said base radially supports said shell in the overlapped region; a metal driving band disposed on outer surfaces of said base and of said shell in said overlapped region; and, a plastic ram ring disposed on said outer surface of said shell in front of said metal driving band in a region of said projectile shell which is not supported by said projectile base.

2. A spin stabilized carrier projectile as defined in claim 1, wherein said ram ring has a rear end surface which lies against a front end surface of said driving band to support said ram ring in an axial direction.

3. A spin stabilized carrier projectile as defined in claim 2, wherein: said ram ring has a front end surface; and at least a portion of an outer circumferential surface of said ram ring extending from said front end surface of said ram ring has a conical taper with a forward cone diameter which is smaller and a rear cone diameter which is larger than the diameter of the rifling in the gun barrel.

4. A spin stabilized carrier projectile as defined in claim 3, wherein said ram ring includes at least one longitudinally extending slot disposed in its said outer circumferential surface.

5. A spin stabilized carrier projectile a defined in claim 3 wherein: outer circumferential surface of said ram ring has a further portion having a diameter equal to said rear cone diameter; and a circumferential groove is provided in said further portion of said outer circumferential surface immediately behind said tapered portion.

6. A spin stabilized carrier projectile as defined in claim 2 wherein: said ram ring has a maximum diameter which is greater than the maximum diameter of said driving band; and a portion of an outer circumferential surface of said driving band extending from said front end surface of said driving band is conically tapered to said maximum diameter.

7. A spin stabilized carrier projectile as defined in claim 1 wherein an outer circumferential surface of said ram ring extends rearwardly from a front end surface of said ram ring with a conical taper having a forward cone diameter which is smaller and a rear cone diameter which is larger than the diameter of the rifling of the gun barrel.

8. A spin stabilized carrier projectile as defined in claim 7 wherein said conical taper extends over the entire length of said outer circumferential surface of said ram ring.

9. A spin stabilized carrier projectile as defined in claim 8 wherein said ram ring is axially spaced from said driving band.

10. A spin stabilized carrier projectile as defined in claim 8 wherein said ram ring includes at least one longitudinally extending slot disposed in its outer circumferential surface.

11. A spin stabilized carrier projectile as defined in claim 7 wherein said conical taper extends over only a part of said length of said outer circumferential surface of said ram ring.

* * * * *